US007919719B2

(12) United States Patent
Chang

(10) Patent No.: US 7,919,719 B2
(45) Date of Patent: Apr. 5, 2011

(54) DOME CONTACT USED IN PUSHBUTTON SWITCH

(75) Inventor: Cheng-Lung Chang, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 0 days.

(21) Appl. No.: 12/192,214

(22) Filed: Aug. 15, 2008

(65) Prior Publication Data

US 2009/0183977 A1 Jul. 23, 2009

(30) Foreign Application Priority Data

Jan. 23, 2008 (CN) ..... 2008 1 0300196

(51) Int. Cl.
*H01H 1/10* (2006.01)

(52) U.S. Cl. ..... 200/513; 200/5 A

(58) Field of Classification Search ..... 200/513
See application file for complete search history.

(56) References Cited

U.S. PATENT DOCUMENTS

| | | | | |
|---|---|---|---|---|
| 4,314,116 | A * | 2/1982 | Gordon | 200/5 A |
| 4,376,238 | A * | 3/1983 | Martin | 200/513 |
| 5,881,866 | A * | 3/1999 | Miyajima et al. | 200/513 |
| 6,683,265 | B2 * | 1/2004 | Masuda | 200/406 |
| 7,605,338 | B2 * | 10/2009 | Karaki et al. | 200/406 |

* cited by examiner

*Primary Examiner* — Renee S Luebke
*Assistant Examiner* — Lheiren Mae A Caroc
(74) *Attorney, Agent, or Firm* — Steven M. Reiss

(57) ABSTRACT

A dome contact (32) for pushbutton switches (300) includes a diaphragm (33) having a reversible dome portion (331), and a bump (34) projecting from a central portion of a convex surface of the dome portion. A method for fabricating the dome contact includes steps of: providing a diaphragm formed by injection molding or screen printing; and forming a bump on a central portion of a convex surface of the diaphragm via thermal extrusion laminating technology of rapid prototyping technology.

6 Claims, 8 Drawing Sheets

DOME CONTACT USED IN PUSHBUTTON SWITCH

BACKGROUND

1. Technical Field

The present invention relates generally to pushbutton switches and particularly to a dome contact used in pushbutton switches and method for fabrication the dome contact.

2. Description of the Related Art

Keypads are widely used for inputting data in the user interfaces of portable electronic devices such as mobile phones, personal digital assistants (PDAs), etc. As shown in FIGS. 7 and 8, a pushbutton switch 100 of a keypad typically includes a button 12, a dome contact 13, and a fixed contact 15. The button 12 is mounted to a housing 10, and has an outer surface exposed from the housing 10 to be pressed by a user. The button 12 includes a bump 125 projecting from a central portion of an inner surface thereof. The dome contact 13 includes a diaphragm 130 and a contact sheet 132. The diaphragm 130 is made from an electrically insulative elastic material. The diaphragm 130 can be actuated from a first dished configuration to a second, opposite dished configuration by external force and, then rebound to the first dished configuration after the external force is released. A central portion of a convex surface of the diaphragm 130 faces the bump 125 of the button 12. The contact sheet 132 is made of electrically conductive material, and is adhered to a central portion of a concave surface of the diaphragm 130. The fixed contact 15 is mounted to a circuit board 17, and faces the contact sheet 132. When the button 12 is pressed, the bump 125 of the button 12 presses against the dome contact 13. The dome contact 13 is elastically deformed, and the contact sheet 132 contacts the fixed contact 15 thereby generating an input signal.

However, when making and assembling the pushbutton switch 10, the bump 125 of the button 12 may be disposed unaligned with the center of the dome contact 13. In this condition, pressing the button 12 requires additional force, and the pushbutton switch 10 cannot provide a desirable tactile feedback characteristic. In addition, since the dome contact 13 is likely to be pressed from its center, the reliability of the contact between the contact sheet 132 and the fixed contact 15 is affected.

Therefore, there is a need to provide an improved dome contact and a method for making the dome contact to overcome the above-described problem.

BRIEF DESCRIPTION OF THE DRAWINGS

Many aspects of the present dome contact and method for fabricating the dome contact can be better understood with reference to the following drawings. The components in the drawings are not necessarily drawn to scale, the emphasis instead being placed upon clearly illustrating the principles of the present dome contact and method for fabricating the dome contact and its potential applications. Moreover, in the drawings, like reference numerals designate corresponding parts throughout the several views.

DETAILED DESCRIPTION OF THE EMBODIMENTS

The present dome contact of pushbutton switch is particularly suitable for electronic devices, such as mobile phones, personal digital assistants (PDAs), etc.

Figure 1:
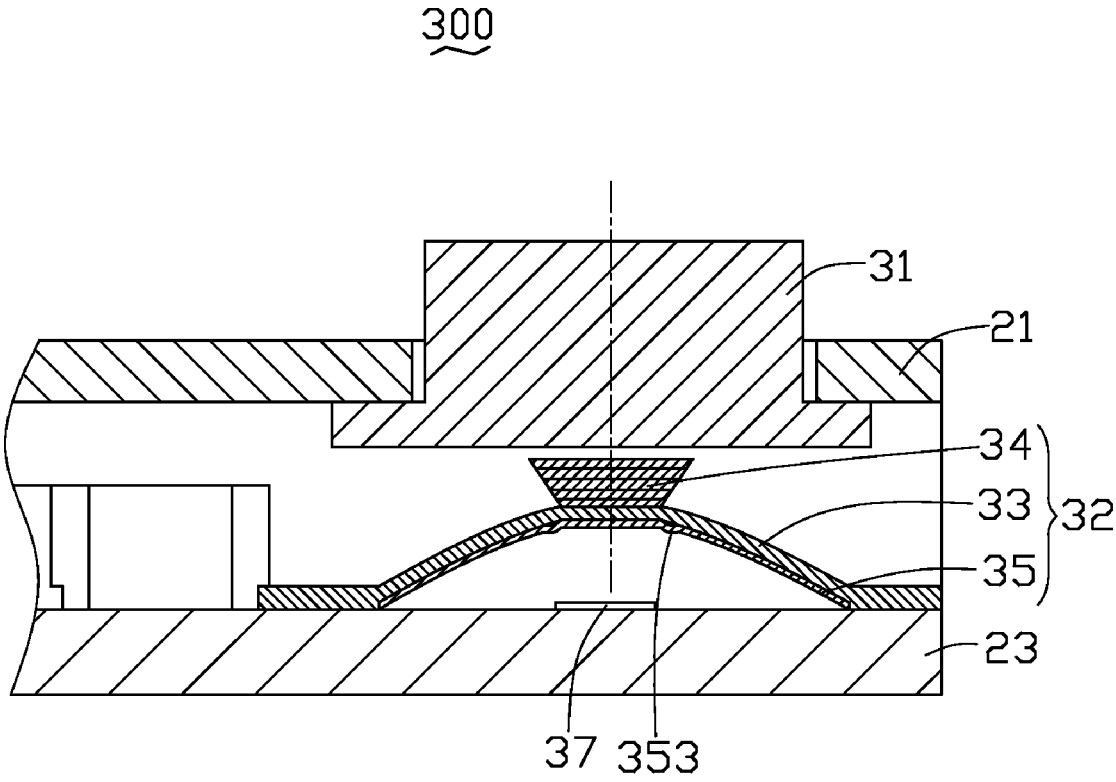
FIG. 1 shows a schematic, cross-sectional view of a pushbutton switch according to an exemplary embodiment.
Figure 2:
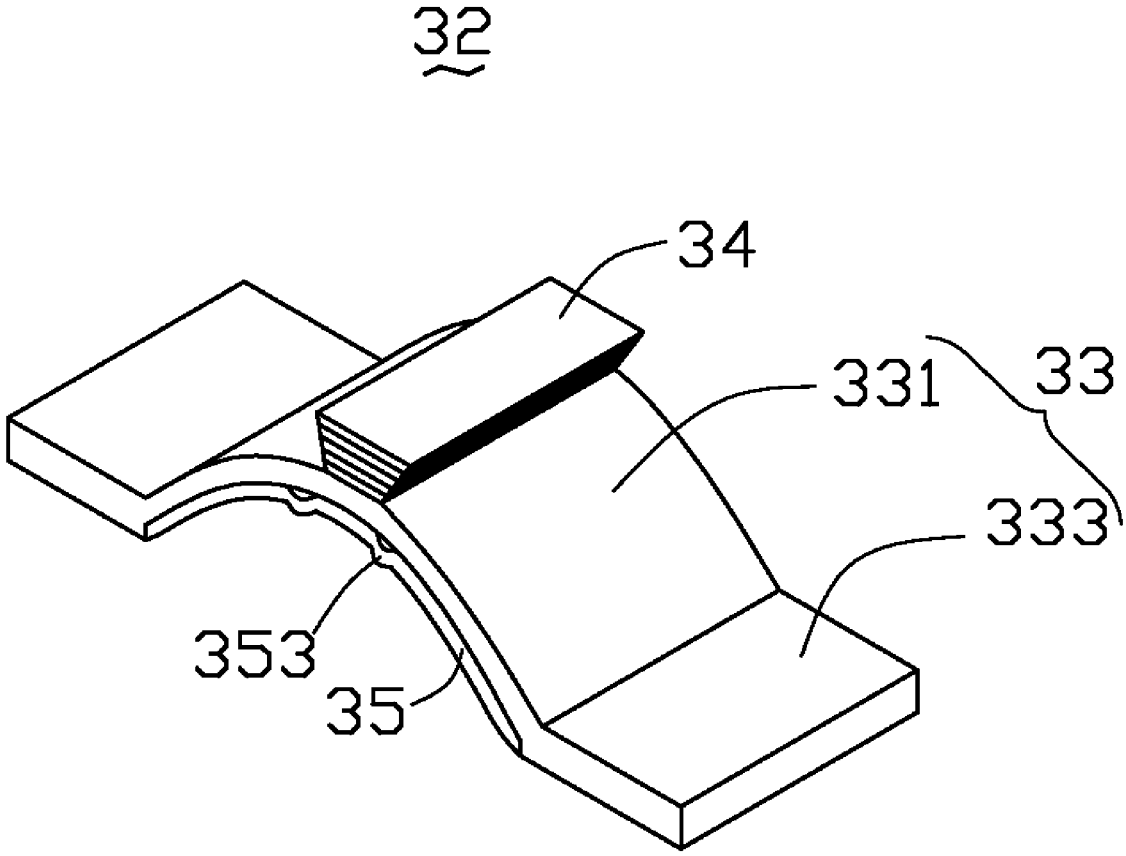
FIG. 2 shows a schematic, perspective view of a dome contact of the pushbutton switch of FIG. 3.
Figure 3:
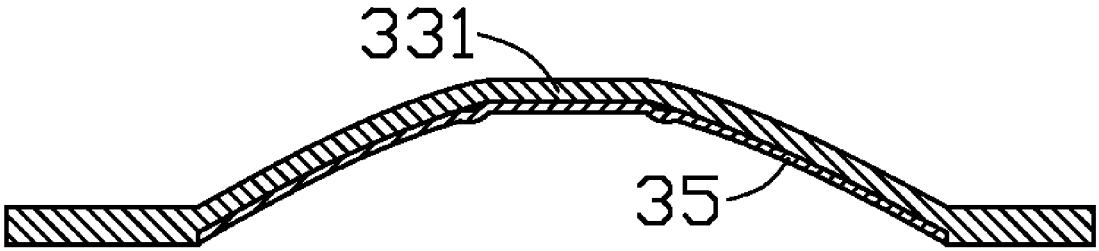
FIGS. 3-6 shows steps of making the dome contact of FIG. 4.
Figure 4:
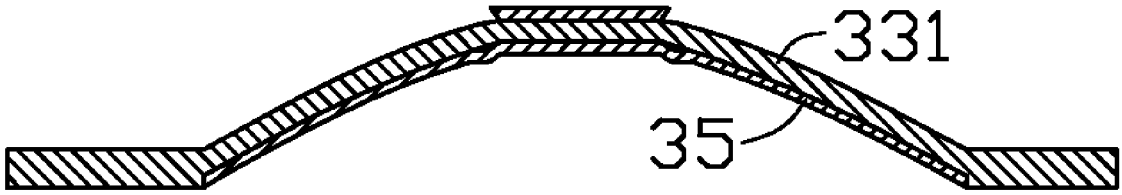
Figure 5:
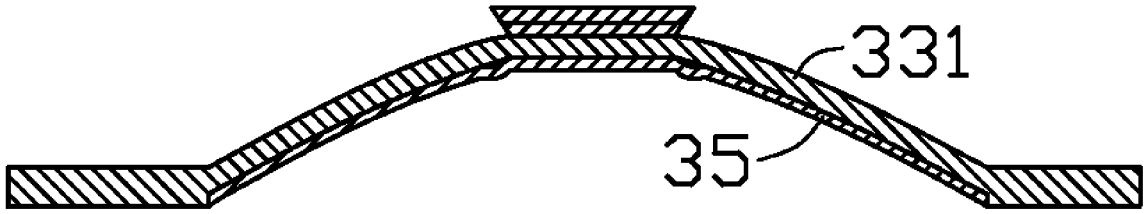
Figure 6:
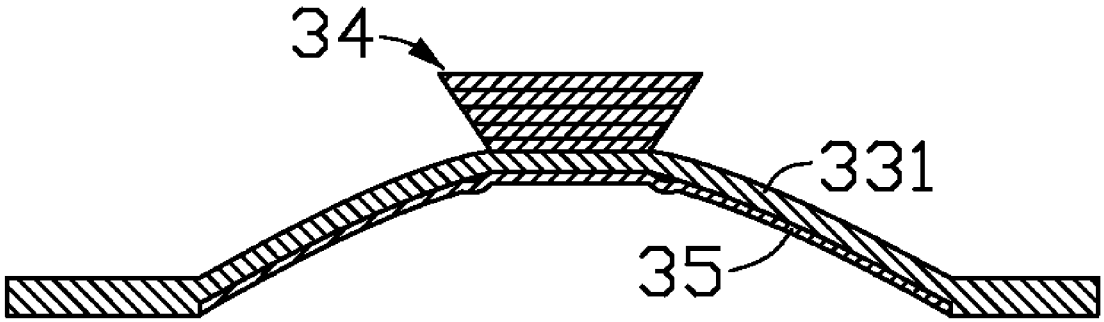
Figure 7:
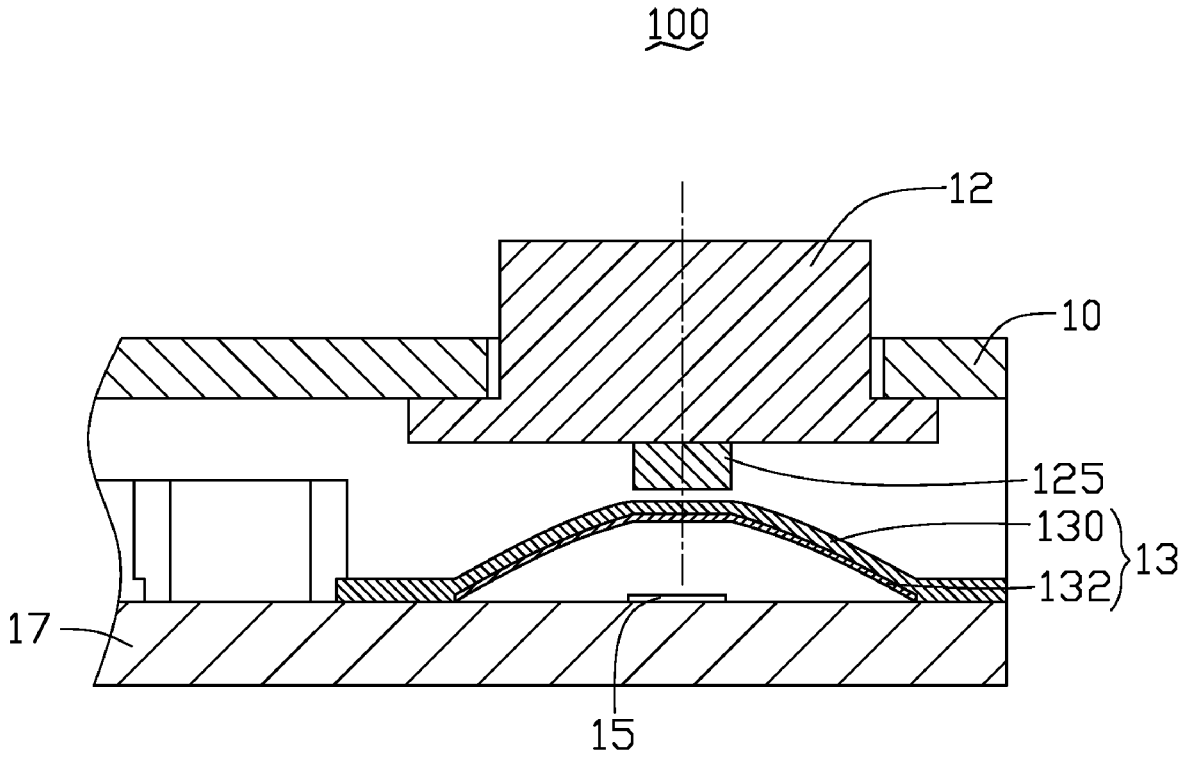
FIG. 7 (RELATED ART)
FIG. 7 shows a schematic, cross-sectional view of a typical pushbutton switch.
Figure 8:
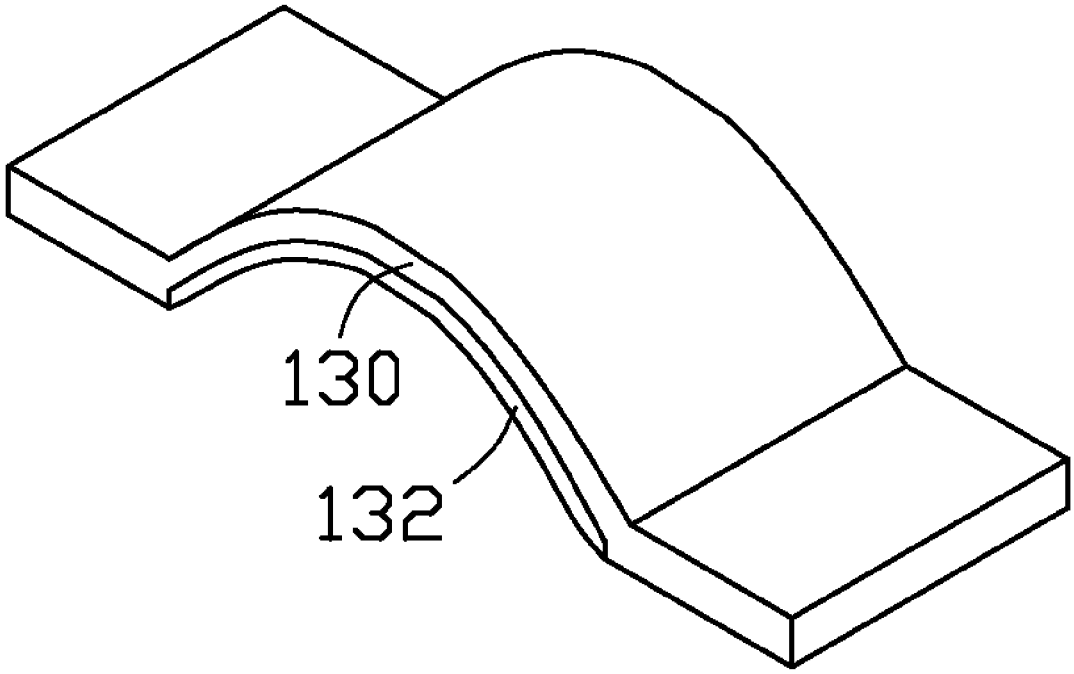
FIG. 8 (RELATED ART)
FIG. 8 shows a schematic, perspective view of a dome contact of the pushbutton switch of FIG. 1.

Referring now to FIGS. 1 and 2, a pushbutton switch 300 used in an electronic device having a housing 21 and a circuit board 23 is shown. The pushbutton switch 300 includes a button 31, a dome contact 32, and a fixed contact 37. The dome contact 32 can be pressed by the button 31 to contact the fixed contact 37.

The button 31 is mounted to the housing 21, and has an outer surface exposed from the housing 21 to be pressed by a user.

The dome contact 32 includes a diaphragm 33, a bump 34 and a contact sheet 35. The diaphragm 33 is made from elastic material, such as plastic material, resin material, or aluminum and so on. In the present embodiment, the diaphragm 33 is made from poly-ethylene terephthalate (PET). The diaphragm 33 includes a dome portion 331 surrounded by a skirt portion 333. The dome portion 331 can be actuated from a first dished configuration to a second, opposite dished configuration by an external force and then rebound to the first dished configuration after the external force is released. The skirt portion 333 extends outwardly from periphery of the dome portion 331. The skirt portion 333 is used to fix the diaphragm 32 to the circuit board 23, and can be mounted to the circuit board 23 by surface mounting technology (SMT). The bump 34 and the contact sheet 35 are mounted on opposite surfaces of the diaphragm 33. The bump 34 projects from a central portion of a convex surface of the dome portion 33 towards the button 31. The bump 34 is preferred to have an isosceles trapezoid shaped cross section, with an end having a smaller area mounted to the dome portion 331. The bump 34 is made from elastic material such as resin material, or plastic material, and is in multilaminate structure. In the present embodiment, the bump 34 is made via thermal extrusion laminating molding technology of rapid prototyping (RP) manufacture technology, so that the bump 34 can be made with a relative large height while having less risk of deforming. The contact sheet 35 is made of electrically conductive material, and is adhered to a concave surface of the dome portion 331. However, the contact sheet 35 can only attach to a central portion of the concave surface of the dome portion 331. The contact sheet 35 has two protrusions 353 projecting therefrom for facilitating connection between the contact sheet 35 and the fixed contact 37. The diaphragm 33 is made from electrically conductive material, the contact sheet 35 can be omitted, and the diaphragm 33 acts as a contacting sheet to electrically contact the fixed contact 37.

The fixed contact 37 is mounted to the circuit board 23, and aligns with a center of the contact sheet 35. The fixed contact 37 can be mounted to the circuit board 23 via surface mounting technology.

In use, when a user presses the button 31, the bump 34 is pressed and causes the diaphragm 33 to dish to an opposite dished configuration. Thus, the contact sheet 35 of the dome contact 32 contacts the fixed contact 37, thereby generating an input signal. After the user releases the force on the button 31, the diaphragm 33 automatically rebounds to its original dished configuration.

Referring to FIGS. 3-6, a method for making the dome contact 32 includes the following steps: providing a diaphragm 33 formed by injection molding or screen printing; providing a contact sheet 35 formed by stamping procedure or injection molding; mounting the contact sheet 35 to the diaphragm 33 using adhesive or thermal extrusion, with the contact sheet 35 being attached to at least a central portion of a concave surface of a dome portion 331 of the diaphragm 33; and forming a bump 34 on a central portion of a convex surface of the diaphragm 33 via thermal extrusion laminating technology of rapid prototyping technology.

The step of forming the bump 34 includes the following sub-steps: forming a first layer of material on the central portion of the convex surface of the dome portion 331; stacking a second layer of material on the first layer of material, with the second layer of material aligning with the first layer of material and having a larger diameter than that of the first layer; and repeating the second sub-step to form multiple layers of material with the latter layer has a larger outline than that of the previous layer until the total height of the layers meet a predetermined height.

In the present embodiment of the pushbutton switch 300, the bump 34 is directly formed on the diaphragm 33 of the dome contact 32. Even if the button 31 is disposed unaligned with the dome contact 32, the bump 34 can still press the central portion of the diaphragm 33. Therefore, the pushbutton switch 300 can provide a desired tactile feedback characteristic and an improved reliability.

It is to be understood, however, that even though numerous characteristics and advantages of the present invention have been set forth in the foregoing description, together with details of the structure and function of the present invention, the disclosure is illustrative only, and changes may be made in detail, especially in matters of shape, size, and arrangement of parts within the principles of present invention to the full extent indicated by the broad general meaning of the terms in which the appended claims are expressed.

What is claimed is:

1. A dome contact for pushbutton switches, comprising:

a diaphragm having a reversible dome portion, and a bump integral with and projecting from a central portion of a convex surface of the dome portion, the bump comprising multiple layers formed by repeatedly stacking layers of material on previous layers of material with each layer of material aligning with the previous layer of material, the bump having an isosceles trapezoid shaped cross section, with the end having a smaller area mounted to the dome portion;

a pushbutton, the pushbutton separate from, but for pressing, the bump.

2. The dome contact as claimed in claim 1, wherein each layer of material having a diameter larger than that of the previous layer of material.

3. The dome contact as claimed in claim 1 further comprising a conductive contact sheet mounted to at least of a central portion of a concave surface of the dome portion.

4. The dome contact as claimed in claim 3, wherein the contact sheet has two protrusions projecting therefrom.

5. The dome contact as claimed in claim 1, wherein the diaphragm further comprises a skirt portion outwardly extending from an outer periphery of the dome portion.

6. A pushbutton switch for portable electronic devices, comprising:

a button configured for being pressed;

a dome contact comprising a diaphragm having a reversible dome portion, and a bump integral with and projecting from a central portion of a convex surface of the dome portion, the bump facing towards and separate from but configured for being pressed by the button; and a fixed contact configured for electrically connecting to the dome portion, the fixed contact and the button disposed at opposite sides of the dome contact;

wherein, the bump comprises multiple layers formed by repeatedly stacking layers of material on previous layers of material with each layer of material aligning with the previous layer of material, the bump has an isosceles trapezoid shaped cross section, with the end having a smaller area mounted to the dome portion.

* * * * *